United States Patent [19]

Mallinson

[11] Patent Number: 4,608,529

[45] Date of Patent: Aug. 26, 1986

[54] CONSTANT VOLTAGE CIRCUITS

[75] Inventor: Andrew M. Mallinson, Salem, N.H.

[73] Assignee: Ferranti plc, Gatley, England

[21] Appl. No.: 650,644

[22] Filed: Sep. 14, 1984

[30] Foreign Application Priority Data

Sep. 15, 1983 [GB] United Kingdom ..... 8324751

[51] Int. Cl.[4] ..... G05F 1/44

[52] U.S. Cl. ..... 323/275; 323/303; 323/231

[58] Field of Search ..... 323/231, 274, 275, 303, 323/907

[56] References Cited

U.S. PATENT DOCUMENTS 4,352,056 9/1982 Cave et al. ..... 323/907

4,459,538 7/1984 Arai et al. ..... 323/275

FOREIGN PATENT DOCUMENTS 56-168236 12/1981 Japan ..... 323/275

*Primary Examiner*—Peter S. Wong

*Assistant Examiner*—Judson H. Jones

*Attorney, Agent, or Firm*—Dennis P. Clarke

[57] ABSTRACT

A constant voltage circuit has two rails 10 and 12, with one rail 12 at a variable potential V, possibly supplied by a voltaic cell. In one arm between the rails there is voltage reference means Z1, 14, with a circuit output line 16 connected thereto, and the line 16 is required to be maintained at a potential $V_o$, corresponding to a maximum value for V. In a second arm there is provided a first resistor R1, connected to the rail 12, and in series with a transistor T2. A second, equal, resistor R2 is connected between the output line 16 and the transistor T2. Means Z2, 30, T3, causes a potential, corresponding to the variable, decreasing, potential V, to be applied between the second resistor R2 and the transistor T2. The current to the transistor T2 is constant over a wide range dV for V, by a compensating current portion dI flowing through the second resistor R2, thereby maintaining $V_o$ constant. Usually, current gain means, such as a transistor T1, is provided, in the first arm, between the output line 16 and the rail 12.

9 Claims, 4 Drawing Figures

CONSTANT VOLTAGE CIRCUITS

Figure 1:
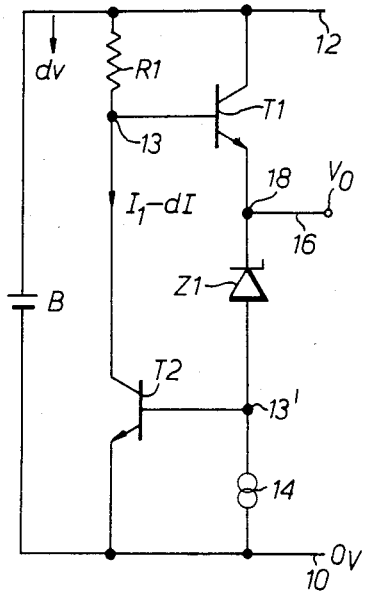
Fig. 1. PRIOR ART

THIS INVENTION relates to constant voltage circuits, each to be driven by a variable voltage supply, such as provided from a source comprising a voltaic cell, the constant voltage circuit including two, parallel, interconnected arms, between two rails, with the variable supply voltage applied between the two rails, in one arm there being provided reference voltage means, possibly, including a Zener diode, a bipolar transistor and a resistor, in series, are provided on the other arm; and an output line for the constant voltage circuit is connected to the reference voltage means, in operation, an, at least substantially, constant output voltage, corresponding to the maximum value for the variable supply voltage, being provided between the output line, and the rail connected to the reference voltage means remote from the output line.

It is an object of the present invention to provide a novel and advantageous form of such a constant voltage circuit, in operation, having an output voltage which is significantly more constant, and/or is capable of being provided over a significantly greater range of supply voltages to the circuit, than has been obtainable previously by such a constant voltage circuit.

According to the present invention a constant voltage circuit has two rails, in operation, a variable supply voltage, from a source, is to be applied between the two rails, and the circuit has, at least, a first arm, and a second arm, connected in parallel between the two rails, reference voltage means is included in the first arm, and the reference voltage means is connected to one rail, an output line for the circuit is connected to the reference voltage means remote from said one rail, included in the second arm is a bipolar transistor, with its base connected to the reference voltage means, at a point to be at a different potential than the potential of the output line, relative to the potential of said one rail, and the second arm also includes a first resistor coupling the transistor to the other of the rails, the circuit also includes a second resistor, of at least substantially equal resistance as the first resistor, the second resistor being connected between a point, in the second arm, between the first resistor and the transistor, and the output line, and the circuit further includes means to cause a potential, which tracks the potential of said other rail, to be applied at said point in the second arm connected to the second resistor.

The source of the variable supply voltage, possibly, comprising a voltaic cell, may, or may not, be considered to be included in a constant voltage circuit in accordance with the present invention.

In the operation of a constant voltage circuit in accordance with the present invention, with the variable supply voltage decreasing from a maximum value, in relation to the current flowing in respect of the transistor, the portion of which current flowing through the first resistor decreasing, however, the current flowing through the transistor is maintained, at least substantially, constant, by a compensating, increasing, portion of the current flowing through the second resistor. Hence, the operating potentials associated with the transistor are maintained, at least substantially, constant, at the values they have when the variable supply voltage has its maximum value, and, in consequence, the output voltage from the circuit, between said one rail and the output line, is maintained, at least substantially, constant. Further, because of the compensating portion of the current, flowing in relation to the transistor, and flowing through the second transistor, the output voltage from the circuit is maintained, at least substantially, constant over a wide range of the variable, decreasing supply voltage.

Conveniently, current gain means is provided in the first arm, between the output line and said other rail, remote from the reference voltage means. The current gain means may comprise another bipolar transistor, the base of said another transistor being connected to a point of the second arm between the first transistor, connected to the reference voltage means, and the first resistor. The current gain means is desirable because there may be a large current flowing in the output line of the circuit.

The means to cause a potential, corresponding to the potential of said other rail to be applied at the point in the second arm connected to the second resistor, may comprise both second reference voltage means in a third arm of the circuit, parallel to the first and second arms, between the two rails, together with a further bipolar transistor, in the second arm, in series between the first transistor, connected to the first mentioned reference voltage means, and the first resistor, the second reference voltage means being connected to the base of the further transistor.

The, or either, reference voltage means provided may comprise a Zener diode in series with a constant current source, a point between the Zener diode and the constant current source being connected to the base of the transistor connected to the reference voltage means, the Zener diode of the first mentioned reference voltage means, if provided, being connected directly to the output line for the circuit.

Figure 3:
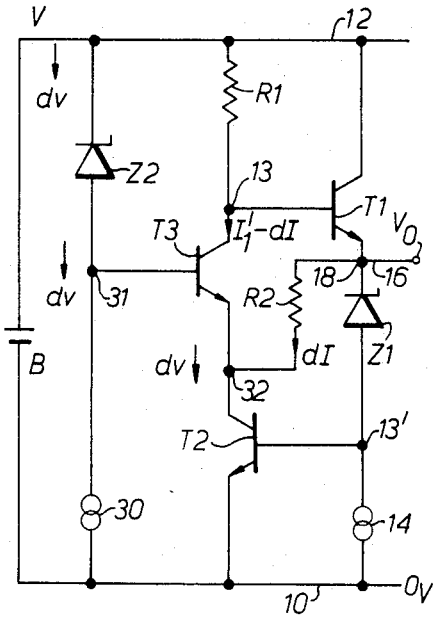
Figure 2:
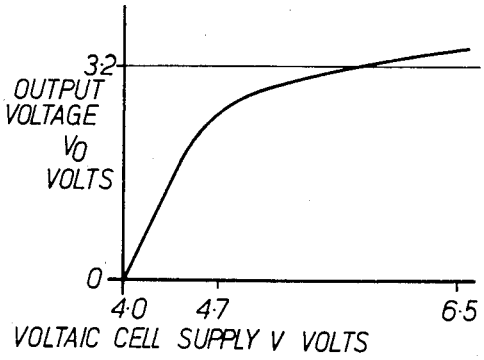
Fig. 2. PRIOR ART
Figure 4:
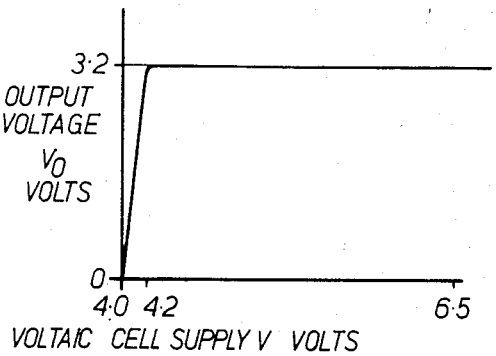

The present invention will now be described by way of example with reference to the accompanying drawings, in which:

FIG. 1 is a diagram of a known form of constant voltage circuit including two rails, with a variable supply voltage to be applied between the rails, and two interconnected arms in parallel between the rails, with reference voltage means in one arm, and a bipolar transistor and a resistor in series in the other arm, an output line for the circuit being connected to the reference voltage means, FIG. 2 is a graph of the variable supply voltages V from a voltaic cell, to the circuit of FIG. 1, against the corresponding output voltages $V_o$ from the circuit, FIG. 3 is of a circuit, corresponding to the circuit of FIG. 1, but is of a modification thereof, comprising one embodiment of a constant voltage circuit in accordance with the present invention, and FIG. 4 corresponds to FIG. 2, but is of a graph of the variable supply voltages V to the circuit of FIG. 3, against the corresponding output voltages $V_o$ from the circuit.

A known form of constant voltage circuit to which the present invention relates, and as shown in FIG. 1, comprises two rails, one rail 10 to be maintained at zero potential, and the other rail 12 to be connected to a source of a variable voltage supply, such as a voltaic cell B. In operation, at any instant, the variable supply voltage of the cell, and the instantaneous potential of the rail 12, is indicated as being V volts. A first NPN transistor T1, and reference voltage means, comprising a Zener diode Z1 and a constant current source indicated generally at 14, are connected in series, in a first arm of the circuit, between the rails 10 and 12, the constant current source 14 being connected to the rail 10, and the collector of the first transistor T1, being connected to the rail 12. Further, a resistor R1 and a second NPN transistor 72 are also connected in series, in a second arm of the circuit, between the rails 10 and 12, the emitter of the second transistor T2 being connected to the rail 10, and the resistor R1 being connected to the rail 12. The base of the first transistor T1 is connected to a point 13 in the second arm between the resistor R1 and the second transistor T2. The base of the second transistor T2 is connected to a point 13' in the first arm between the Zener diode Z1 and the constant current source 14. The circuit provides a substantially constant output potential $V_o$ volts, with reference to zero potential maintained on the rail 10, on a line 16 connected to a point 18 between the first transistor T1 and the Zener diode Z1, the constant output potential $V_o$ corresponding to the maximum supply potential V on the rail 12.

The constant potential $V_o$, provided on the output line 16, is equal to the reference voltage drop across the Zener diode Z1, plus the base-emitter P-N junction voltage drop $V_{be}$ associated with the second transistor T2.

The constant current source 14 is provided in order to ensure that there is a sufficient current flow through the Zener diode Z1, under all normally-encountered operation conditions of the constant voltage circuit, for the Zener diode to be operable.

The first transistor T1, comprising current gain means, is provided to ensure that there is sufficient current flowing in the output line 16.

In general, as the supply potential V of the rail 12 falls from its maximum value, by an amount dV, the current $I_1$, flowing into the collector of the second transistor T2 falls by an amount dV/R1, or dI. This change in the current flowing into the second transistor T2, through the resistor R1, causes a small, corresponding decrease in the potential difference $V_{be}$ across the base-emitter P-N junction of the second transistor. Hence, there is a corresponding small decrease in the potential $V_o$ of the output line 16. In one particular embodiment of the circuit of FIG. 1, if the current $I_1$ flowing into the second transitor T2 is halved, the potential difference $V_{be}$ across the base-emitter P-N junction of this transistor falls only by 18 milli-volts, and the potential $V_o$ of the output line 16 falls by the same, small, amount.

As the supply voltage V from the voltaic cell falls steadily, from its maximum value, the potential $V_o$ of the output line 16 also falls steadily, but at a less rapid rate, until there is an insufficient voltage drop across the resistor R1 for the resistor to exercise the required control on the current $I_1$, flowing into the collector of the second transistor T2. Eventually, as the supply voltage V falls still further, the second transistor T2 ceases to conduct, and the constant voltage circuit becomes wholly inoperable.

In the operation of one embodiment of the known constant voltage circuit of FIG. 1, and as shown in FIG. 2, the supply voltage V of the voltaic cell, with use, falls at a steady rate, from a maximum value of 6.5 volts. It is required that the potential $V_o$ on the output line 16 of the circuit is at least substantially constant, at 3.2 volts, for as low a cell supply voltage V as possible. The output potential $V_o$ of the line 16 is slightly above the required value of 3.2 volts when the supply voltage V is the maximum value of 6.5 volts, and steadily falls, at a much slower rate than the supply voltage falls, to a value slightly below the required value of 3.2 volts, when the supply voltage V is approximately 4.7 volts. As the supply voltage V then falls steadily below 4.7 volts, the output potential $V_o$ of the line 16 now falls at a rapid rate, until the output potential $V_o$ is 0 volt when the supply voltage V is approximately 4.0 volts.

A constant voltage circuit in accordance with the present invention is shown in FIG. 3. Parts of the circuit of FIG. 3 identical with, or closely resembling, parts of the known constant voltage circuit of FIG. 1, are identified by the same reference numbers in both Figures.

The circuit of FIG. 3 differs from the known circuit of FIG. 1 in that means to apply a potential, which tracks the potential V of the rail 12, to the collector of the second transistor T2 is provided. The means comprises a third NPN transistor T3, in the second arm, between the resistor R1 and the second transistor T2; and second reference voltage means, comprising a Zener diode Z2 and a second constant current source indicated generally at 30, connected in series, in a third arm of the circuit, between the rails 10 and 12, with the second constant current source 30 connected to the rail 10, and the second Zener diode Z2 connected to the rail 12; the base of the third transistor T3 being connected to a point 31 in the third arm between the second Zener diode 22 and the second constant current source 30. Further, a second resistor R2 is connected at one end to the point 18 in the first arm, between the first transistor T1 and the first Zener diode Z1, and, hence, also is connected to the output line 16; and the second resistor R2 is connected at the other end to a point 32 in the second arm between the third transistor T3 and the second transistor T2, at which point 32 a potential, corresponding to the potential V of the rail 12, is applied by the means Z2, 30, T3. The first and second resistors, R1 and R2, have the same resistance. The reference voltage drop across the second Zener diode Z2 is considerably less than the reference voltage drop across the first Zener diode Z1.

The circuit arrangement is balanced in operation, in that its manner of operation is unaffected by changes in the operating temperature associated with the circuit.

The second constant current source 30 is provided in order to ensure that there is a sufficient current flow through the second Zener Z2, under all normally-encountered operating conditions of the constant voltage circuit, for the second Zener diode Z2 to be operable.

In general, the circuit of FIG. 3 is required to operate so that the manner of operation of the second transistor T2 is apparently independent of variations of the supply potential V of the rail 12, over as wide a range as possible of such supply potential variations.

If the supply potential V of the rail 12 falls by an amount dV, from its maximum possible value, there is an equal fall dV in the potential at the point 31 between the second Zener diode Z2 and the second constant current source 30, which point 31 is also connected to the base of the third transistor T3. There is also an equal fall dV in the potential at the point 32 between the second and thrid transistors T2 and T3, to which point 32 a potential, which tracks the potential V of the rail 12, is applied by the means Z2, 30, T3, and which point 32 is also connected to the second resistor R2. Because of this fall dV in potential in the collector circuit of the second transistor T2, there tends to be a corresponding fall in the current $I_1'$ in the collector circuit of the third transistor T3 of dV/R1, of dI. However, there is caused to be a compensating current portion dI flowing through the second resistor R2, from the output line 16, to the collector of the second transistor T2, because of the drop in the potential dV in the collector circuit of the second transistor relative to the constant potential $V_o$ of the output line 16. Because the resistance of the second resistor R2 is equal to that of the first resistor R1; and because the change in the potential dV across the first resistor R1 is equal to the potential dV across the second resistor R2; the portion of the current dV/R2, or dI, flowing into the collector circuit of the second transistor from the second resistor, to a close approximation, is equal to, and of opposite sense to, the change dI in the current flowing into the collector circuit of the second transistor because of the change dV in the potential across the first resistor R1. Thus, to a close approximation, the potential difference $V_{be}$ across the base-emitter P-N junction of the second transistor T2 remains constant, as does the potential $V_o$ of the output line 16, as the potential V of the supply rail 12 falls.

Hence, as the supply voltage V from the voltaic cell falls steadily, from its maximum value, the potential $V_o$ of the output line 16 remains substantially constant, until there is an insufficient voltage drop across the first resistor R1 for the resistor to exercise the required control on the current, substantially $I_1'$, flowing into the collector of the second transistor T2. Further, because of the portion dI of the current flowing into the collector of the second transistor T2 from the second resistor R2, the required degree of control on the current flowing into the collector of the second transistor exercised by the first resistor R1, of the circuit of FIG. 3, occurs down to a lower supply voltage V than for the known circuit of FIG. 1. Eventually, as the suppply voltage V falls still further, the constant voltage circuit of FIG. 3 becomes wholly inoperable.

The manner of operation of one embodiment of the constant voltage circuit of FIG. 3 is shown in FIG. 4, FIG. 4 corresponding to FIG. 2 showing the equivalent manner of operation of one embodiment of the known constant voltage circuit of FIG. 1. In the operation of the typical embodiment for the constant voltage circuit of FIG. 3, and in accordance with the present invention, the potential $V_o$ on the output line 16 of the circuit is at least substantially constant, at 3.2 volts, as the supply voltage V of the voltaic cell falls from 6.5 volts to approximately 4.2 volts. As the supply voltage V then falls at a steady rate below 4.2 volts, the output potential $V_o$ of the line 16 now falls at a rapid rate, until the output potential $V_o$ is 0 volts when the supply voltage V is approximately 4.0 volts. By a comparison of FIG. 4 with FIG. 3, it can be seen that the constant voltage circuit of FIG. 3, in accordance with the present invention, has a significantly more constant output voltage $V_o$, over a significantly greater range of supply voltages V, than the known constant voltage circuit of FIG. 1.

In general for a circuit in accordance with the present invention, the output voltage $V_o$ from the circuit of FIG. 3 is significantly more constant, and/or is capable of being provided over a significantly greater range of supply voltages V to the circuit, than has been obtainable previously by such constant voltage circuits.

Thus, for example, the second resistor R2 may not be exactly of the same resistance as the first resistor R1. If the resistance of the second resistor R2 is slightly smaller than the resistance of the first resistor R1, then, as the variable supply voltage V initially falls from its maximum value, the output voltage $V_o$ from the circuit, steadily, rises at a slow rate. Alternatively, if the resistance of the second resistor R2 is slighty larger than the resistance of the first resistor R1, then, as the variable supply voltage V initially falls from its maximum value, the output voltage $V_o$ from the circuit, steadily, falls at a slow rate.

Reference voltage means, instead of comprising the first Zener diode Z1 and first constant current source 14, or the second Zener diode Z2 and second constant current source 30, may have any convenient form, for example, comprising a three transistor Widlar circuit.

The second reference voltage means, for example, comprising the second Zener diode Z2, and constant current source 30, together with the third transistor T3, may be replaced by any convenient form of means to apply a potential, corresponding to the supply rail potential V, to the end 32 of the second resistor R2 remote from the output line 16 for the circuit.

The bipolar transistor T1 may be replaced by any convenient form of current gain means; or such current gain means may be omitted, the first Zener diode Z1, if provided, being connected directly to the rail 12.

Usually, but not essentially, the rail 10 is maintained at zero potential. If the rail 10 is not maintained at zero potential, then the supply potential V of the rail 12 is required to be more positive than the potential of the rail 10.

The second transistor T2, and the first transistor T1, and the third transistor T3, if provided, each may comprise a PNP transistor, the circuit arrangement being modified accordingly.

What I claim is:

1. A constant voltage circuit comprising:

first and second rails connectable to a variable supply voltage source;

a first arm and a second arm connected in parallel between said rails;

said first arm including a first reference voltage means having first, second and intermediate terminals, said intermediate terminal having a different potential than said second terminal relative to said first terminal, and said first reference voltage means first terminal being connected to said first rail;

a circuit output line connected to said first reference voltage means second terminal;

said second arm including a first bipolar transistor having a pair of main terminals and a base terminal, said first bipolar transistor base terminal being connected to said first reference voltage means intermediate terminal, and one of said first bipolar transistor main terminals being connected to said first rail, and said second arm also including a first resistor coupling the other of said first bipolar transistor main terminals to said second rail, a first intermediate point in said second arm being defined intermediate said first resistor and said other of said first bipolar transistor main terminals;

a second resistor having a resistance value comparable to that of said first resistor and connected between said first intermediate point in said second arm and said output line; and means for causing a potential which tracks the potential of said second rail to be applied to said first intermediate point in said second arm.

2. A circuit as claimed in claim 1, wherein said first arm further includes gain means between said output line and said second rail.

3. A circuit as claimed in claim 2, wherein:

a second intermedite point is defined in said second arm intermediate said first resistor and said other of said bipolar transistor main terminals; and wherein said current gain means comprises another bipolar transistor having a pair of main terminals and a base terminal, said other bipolar transistor base terminal being connected to said second intermediate point, one of said other bipolar transistor main terminals being connected to said output line, and the other of said the bipolar transistor main terminals being connected to said second rail.

4. A circuit as claimed in claim 1, wherein said means for causing a potential which tracks the potential of said second rail to be applied to said first intermediate point in said second arm comprises:

a third arm connected between said rails parallel to said first and second arms, said third arm including a second reference voltage means; and a further bipolar transistor included in said second arm and having a pair of main terminals and a base terminal, said further bipolar transistor main terminals being connected in series between said other of said first bipolar transistor main terminals and said first resistor, and said further bipolar transistor base terminal being connected to said second reference voltage means.

5. A circuit as claimed in claim 4, wherein said first and second reference voltage means each comprises a Zener diode and a constant current source in series therewith, an intermediate point betwen the Zener diode and the constant current source of said first reference voltage means constituting said intermediate terminal to which said first bipolar base terminal is connected, and an intermediate point between the Zener diode and the constant current source of said second reference voltage means being connected to said further bipolar transistor base terminal.

6. A circuit as claimed in claim 1, wherein:

said second rail is maintained during operation at a positive potential relative to said first rail;

said first bipolar transistor is an NPN transistor, said one of said first bipolar transistor main terminals connected to said first rail being an emitter terminal, and said other of said first bipolar transistor main terminals being a collector terminal and constituting said first interemediate point to which said second resistor is connected.

7. A circuit as claimed in claim 6, wherein said first arm further includes current gain means comprising another NPN transistor having emitter, collector and base terminals, said other NPN transistor collector terminal being connected to said second rail, said other NPN transistor emitter terminal being connected to said output line, and said other NPN transistor base terminal being connected to said first resistor.

8. A circuit as claimed in claim 6, wherein said means for causing a potential which tracks the potential of said second rail to be applied to said first intermediate point in said second arm comprises a further NPN transistor having a collector terminal connected to said first resistor, an emitter terminal connected to said first bipolar transistor collector terminal, and a base terminal connected to a reference which tracks the potential of said second rail.

9. A circuit as claimed in claim 1, which comprises the variable voltage supply source, the source being a voltaic cell.

* * * * *